United States Patent [19]

Shoemaker

[11] Patent Number: 4,613,435

[45] Date of Patent: Sep. 23, 1986

[54] MAGNETIC OIL FILTER

[76] Inventor: Fred N. Shoemaker, 264 N. 56th St., Mesa, Ariz. 85205

[21] Appl. No.: 751,151

[22] Filed: Jul. 2, 1985

[51] Int. Cl.[4] ..... B03C 1/02

[52] U.S. Cl. ..... 210/222; 210/85; 210/477

[58] Field of Search ..... 55/100; 123/196 A; 209/223 R, 232; 210/223, 222, 695, 85, 473, 477

[56] References Cited

U.S. PATENT DOCUMENTS

| | | | |
|---|---|---|---|
| 1,778,910 | 10/1930 | Niven | 210/223 |
| 2,603,353 | 7/1952 | Cooney | 210/223 |
| 2,798,611 | 7/1957 | Prevost | 210/222 |
| 4,469,076 | 9/1984 | Wolff | 210/222 X |

*Primary Examiner*—Richard V. Fisher
*Assistant Examiner*—W. Gary Jones
*Attorney, Agent, or Firm*—Harry M. Weiss & Associates

[57] ABSTRACT

The present invention relates to a filter for removing particulate matter from a flow of lubricating oil. According to the present invention there is employed an inner and an outer generally cylindrical shaped container. The inner and outer containers are separated by flexible sealing members firmly attached to a top plate member of the inner container. A highly magnetized magnetic plate having a plurality of apertures, is firmly attached within the inner container. Oil flows through the magnetic apertures, and any particulate matter susceptible to a magnetic force is separated from the oil before its return flow to the engine.

5 Claims, 2 Drawing Figures

MAGNETIC OIL FILTER

BACKGROUND OF THE INVENTION

This invention relates generally to oil filters for use in vehicles requiring lubrication. More particularly, this invention relates to an oil filter employing magnets to remove substantially all abrasive ferrous metals present in the oil. It is well known that abrasive metal particles exist in lubricating oil which has passed through an engine. If these abrasive metal particles are not filtered from the oil, they will erode the cylinder walls and piston rings of an engine thereby leading to mechanical problems in the engine.

Conventional oil filters remove particulate matter from lubricating oil by passing the oil through a series of porous paper-like materials. After a period of time, these conventional oil filters become clogged with oil sludge resulting from particulate matter build-up on the porous paper-like materials. The formation of this sludge significantly impairs an oil filter's ability to remove harmful abrasive particulate materials present in the oil. The abrasive materials then return to the engine with reduced lubricating capacity. Thus, instead of providing adequate lubrication to the metal parts within an engine, this adulterated oil gradually grinds away and erodes the engine cylinder walls and piston rings.

There is, therefore, a great need for an oil filter with an improved ability to remove abrasive metal particles present in lubricating oil.

SUMMARY OF THE INVENTION

Accordingly, it is an object of the present invention to provide an oil filter with improved lubricating properties.

It is another object of the present invention to provide an oil filter which is not prone to clogging due to sludge development.

It is a further object of the present invention to provide an oil filter which will effectively, over a great period of time, provide superior removal of metal particle present in lubricating oil.

It is still another object of the present invention to provide an oil filter employing magnetic plates to effectively and efficiently remove substantially all ferrous metal particles present in engine lubricating oil.

The foregoing and other objects, features and advantages of the present invention will be apparent from the following more particular description of the preferred embodiments of the invention, as illustrated in the accompanying drawings.

DESCRIPTION OF THE PREFERRED EMBODIMENT

Figure 1:
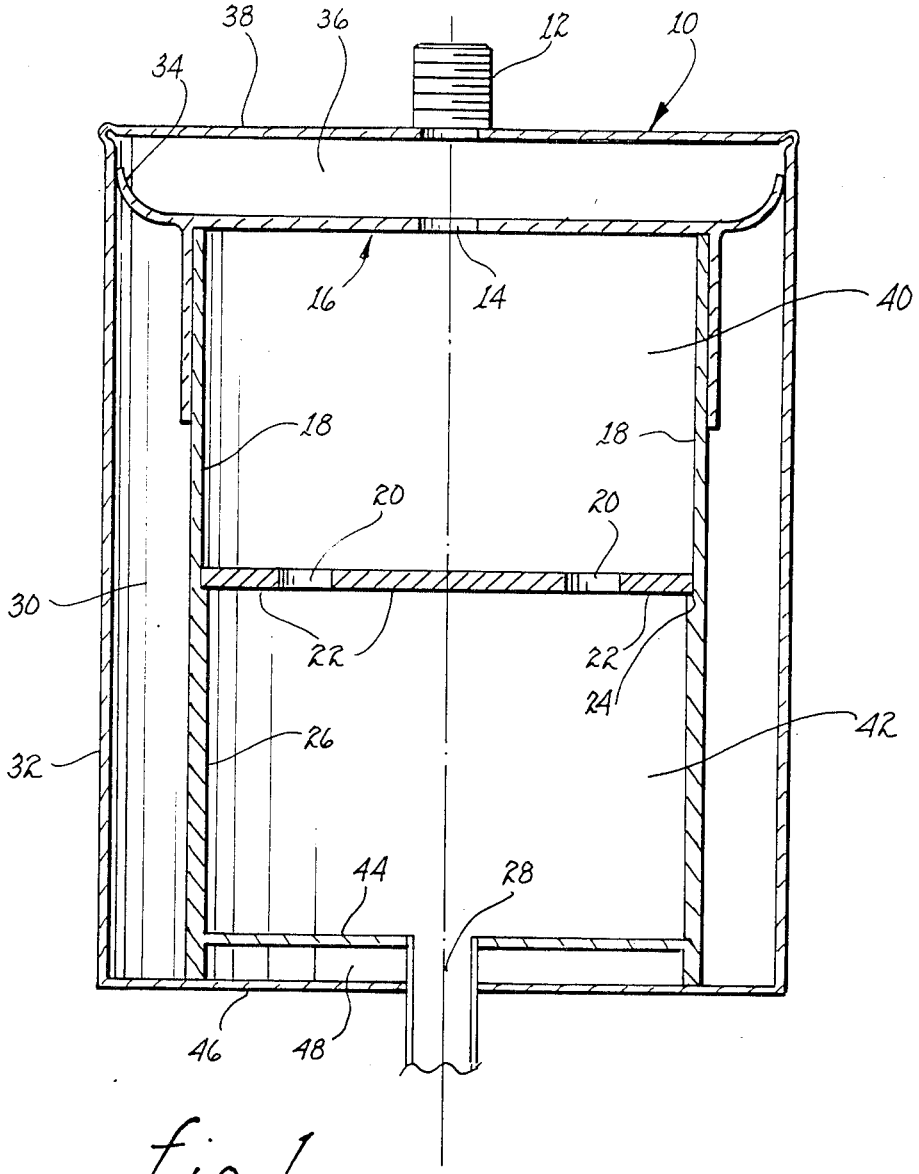
FIG. 1 is a cross-sectional view of an oil filter according to the present invention.

In FIG. 1 there is shown a generally cylindrical shaped oil filter 10 according to the present invention. Oil filter 10 consists of a generally cylindrical container having an outer top plate member 38 having an oil inlet aperture 12 passing therethrough, outer side walls 32 and outer bottom plate 46 having oil outlet aperture 28 passing therethrough. Oil flows from the engine of a vehicle into oil filter 10 at oil inlet 12. The flow of oil is regulated by top space 36 defined by a outer top plate member 38, inner top plate member 16 having an oil inlet aperture 14 passing therethrough and flexible sealing members 34. Flexible sealing members 34 are suitably made of oil resistant materials such as plastic or rubber. Oil flows from top space 36 passing through inlet aperture 14 into an upper chamber 40 of the oil filter. Upper chamber 40 of the oil filter is defined by inner top plate member 16, top side wall 18 and highly magnetized magnetic plate 22 having a plurality of magnetic apertures 20 passing therethrough. Oil contained in upper chamber 40 of the oil filter is subjected to magnetic forces emanating from magnetic plate 22 having a plurality of magnetic apertures 20 passing therethrough. Magnetic plate 22 is firmly held in place by retaining seat 24 having, as an upper portion, top side wall 18, and as a lower portion, bottom side wall 26; top side wall 18 being relatively thicker than bottom side wall 26.

Substantially all of the ferrous metal particles present in the lubricating oil are magnetically separated from the oil and adhere to magnetic plate 22, being thereby effectively removed from the flow of oil returning to lubricate the engine.

Magnetic apertures 20 allow oil to flow from upper chamber 40 of the oil filter to a lower chamber 42 of the oil filter. Lower chamber 42 of the oil filter is defined by bottom side wall 26, magnetic plate 22 having a plurality of magnetic apertures 20 passing therethrough and inner bottom plate 44 having an outlet aperture 28 passing therethrough.

Side chamber 30, defined by top and bottom side walls 18,26, outer side wall 32 and flexible sealing members 34, protects against oil leakage in the event outer wall 32 is punctured. Bottom chamber 48, interdisposed between outer bottom plate member 46 and inner bottom plate member 44 having aperture 28 passing therethrough, provides protection against oil leakage in the event outer bottom plate member 46 is punctured.

Figure 2:
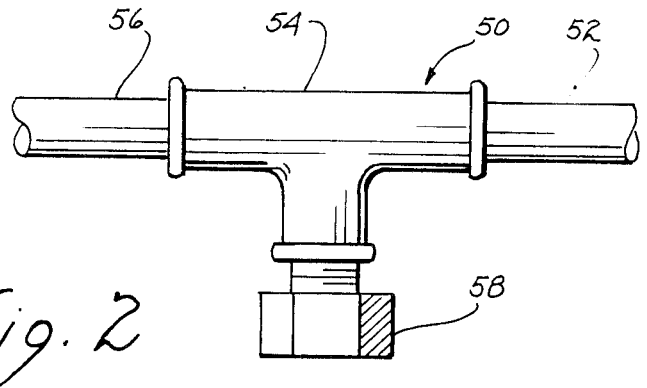
FIG. 2 is a side elevational view of a device for checking the efficiency of the oil filter according to the present invention.

In FIG. 2 there is shown an oil line checking device 50 provided in conjuction with oil filter 10 of FIG. 1. Oil line device 50 serves as a means for determining whether any sludge is present in the oil flow. Oil line checking device 50 is removably connected to an oil line inlet 52 and an oil line outlet 56. A body 54 is provided with a removably attached plug 58. When a vehicle owner or vehicle service man desires to determine whether the lubricating capacity of an oil is depleted by the presence of sludge, plug 58 is removed and oil is allowed to flow from the body to ascertain its sludge content. If, however, it is found that no oil flows from the oil line checking device, the oil filter is completely obstructed with sludge and must be replaced.

It has been found that the oil filter according to the present invention filtered substantial quantities of metal particulate matter from engine oil without appreciable sludge formation for a period of six months and for 18,000 miles driven. Whereas testing of 100 conventional oil filters removed from cars after 1,000 miles of use revealed that only 2 percent of these did not suffer from significant sludge obstructions almost completely restricting any return flow of filtered oil to the engine.

While the invention has been particularly shown and described in reference to the preferred embodiments thereof, it will be understood by one skilled in the art, that various changes in form and details may be made therein without departing from the spirit and scope of the present invention.

I claim:

1. A filter for removing particulate matter from lubricating oil, comprising:

an outer container, said container having a top plate member having at least one oil inlet aperture passing therethrough, and a bottom plate member having at least one oil outlet aperture passing therethrough;

an inner container having an inner top plate member having at least one oil inlet aperture passing therethrough, and an inner bottom plate member having at least one oil outlet aperture passing therethrough;

a highly magnetized magnetic plate means having a plurality of apertures passing therethrough, firmly attached within said inner container for removing undesired metallic particulate matter from lubricating oil passing therethrough;

said inner top plate member further having flexible sealing means for contacting an inner surface of said outer container thereby firmly seating said inner container away from said outer container;

said inner container further comprising inner side walls having an upper portion and a lower portion thereof, thereby forming a ledge for firmly holding said highly magnetized magnetic plate means having said plurality of apertures passing therethrough;

an upper chamber being defined by said inner top plate member having said oil inlet aperture passing therethrough, said upper portion of said side walls, and said highly magnetized magnetic plate means having said plurality of apertures passing therethrough; and a lower chamber being defined by said highly magnetized magnetic plate means having said plurality of apertures passing therethrough, said lower portion of said side walls, and said inner bottom plate.

2. A filter for removing particulate matter from lubricating oil according to claim 1, wherein said inner container is constructed from any suitable non-magnetic material.

3. A filter for removing particulate matter from lubricating oil according to claim 1, wherein said flexible sealing members comprise oil resistant plastic.

4. A filter for removing particulate matter from lubricating oil according to claim 1, wherein said flexible sealing members comprise oil resistant rubber.

5. A filter for removing particulate matter from lubricating oil according to claim 1, wherein said flexible sealing means separates said inner container from said outer container by chamber means for separating said inner container from said outer container comprising a side chamber, defined by said inner side walls and said flexible sealing means of said inner container and said outer bottom plate having an oil outlet aperture passing therethrough of said outer container;

a bottom chamber, defined by said inner side walls and said inner bottom plate member having said oil outlet aperture passing therethrough of said inner container and said bottom plate member having said oil outlet aperture passing therethrough of said outer container; and an outer top chamber, defined by said top plate member having said oil inlet aperture passing therethrough and said outer side walls of said outer container, and said inner top plate having said flexible sealing means of said inner container.

* * * * *